United States Patent [19]

Mock

[11] 3,972,165

[45] Aug. 3, 1976

[54] SURROUND MOLDING WITH FASTENER CONCEALMENT MEMBER FOR USE ON PARTICLE BOARD DOORS

[75] Inventor: Donald E. Mock, Covina, Calif.

[73] Assignee: Reed Irrigation Systems, El Monte, Calif.

[22] Filed: Nov. 14, 1975

[21] Appl. No.: 631,950

[52] U.S. Cl. ..... 52/309; 49/501; 52/627; 52/729; 428/81; 428/83; 428/191; 428/194

[51] Int. Cl.[2] ..... E04C 2/10; E04C 2/38

[58] Field of Search ..... 52/627, 628, 716, 717, 52/288, 309, 623–626, 729; 49/501; 428/81, 83, 191, 194, 310, 315, 188, 358

[56] References Cited

UNITED STATES PATENTS

| | | | |
|---|---|---|---|
| 1,989,276 | 1/1935 | Howard | 428/358 |
| 3,105,323 | 10/1963 | Esler et al. | 52/716 X |
| 3,426,482 | 2/1969 | Mock | 49/501 |
| 3,443,345 | 5/1969 | Spencer | 52/288 X |
| 3,479,770 | 11/1969 | Mock | 52/627 X |
| 3,568,386 | 3/1971 | Gossen | 52/716 X |

FOREIGN PATENTS OR APPLICATIONS

| | | | |
|---|---|---|---|
| 707,549 | 4/1965 | Canada | 52/309 |

*Primary Examiner*—Alfred C. Perham
*Attorney, Agent, or Firm*—Gordon L. Peterson

[57] ABSTRACT

A molding for a panel comprising first and second elongated channels opening in opposite directions. The first elongated channel is adapted to receive an elongated peripheral portion of the panel. A fastener concealment member is located in the second elongated channel. The fastener concealment member includes foam plastic material. A fastener can be driven through the foam plastic material and the molding into a panel to attach the molding to the panel.

12 Claims, 5 Drawing Figures

SURROUND MOLDING WITH FASTENER CONCEALMENT MEMBER FOR USE ON PARTICLE BOARD DOORS

BACKGROUND OF THE INVENTION

It is often necessary or desirable to provide a molding on a hinged or sliding door structure. For example, in building a cabinet, solid sheets of particle board or other material are joined together to form the walls of the cabinet. A panel is then cut from the cabinet wall to form a door opening. To save material and labor, this panel is then used as a major portion of the door for such opening.

The panel cutting operation removes a width of the wall so that the panel is smaller than the opening. In addition, the edges of the panel tend to be rough and unsightly. To cover the rough edges and to increase the area of the door sufficiently so that it completely closes the opening, a molding can be attached to the panel. Examples of door moldings are disclosed by way of example in U.S. Pat. Nos. 3,426,482, 3,479,770 and 3,554,627, all of which issued to D. E. Mock.

One problem with using a molding is how to attach the molding to the panel in an unobtrusive manner. Usually it is necessary to use penetrating fasteners such as nails and/or staples to attach the molding to the panel. Even if the panel and molding are to be adhesively attached, it is usually necessary to use fasteners to hold the molding and the panel together while the adhesive hardens. If the heads of the fasteners remain visible, it significantly detracts from the appearance of the door structure. To the extent that the appearance of the door structure is adversely effected, the molding fails to achieve one of its basic purposes.

SUMMARY OF THE INVENTION

The present invention provides a new way of inexpensively concealing fasteners used to attach a molding to a panel. This is advantageously accomplished by providing a recess in the molding and placing a fastener concealment member in the recess. The nail or other fastener can be driven through the fastener concealment member and the adjacent portion of the molding and into the panel to attach the molding to the panel. The head of the fastener is driven below the surface of the fastener concealment member so that it is substantially concealed.

The fastener concealment member can be constructed of any material which can be readily penetrated by the fastener and the head of the fastener and which is capable of covering or partly covering a fastener head driven into the material. At least the outer surface of the fastener concealment member is preferably rigid. A soft or resilient outer surface would tend to form a large area depression as the head of the fastener is driven into it. Such a large area depression would draw attention to the fastener. A rigid outer surface on the other hand will deform only very locally at the fastener and tend to cover the head of the fastener. Accordingly, a much greater concealing effect is obtained.

The fastener concealment member is typically thicker and softer than adjacent portions of the molding which are to be penetrated by the fasteners. The material of the fastener concealment member may also be of less density than other portions of the molding.

A preferred material for the fastener concealment member is a plastic material such as foam plastic. Either open or closed cell foam can be used. Cellular plastic is easily penetrated by fasteners, and the cells readily collapse to permit the head of the fasteners to be sunk into it.

The recess can advantageously take the form of an elongated channel on the outer surface of the molding. Similarly, the fastener concealment member is preferably elongated and extends for the full length of the channel. By elongating the fastener concealment member and the channel in which it is positioned, the builder can drive fasteners through the molding at any location which he desires along the fastener concealment member. In addition, a structure of continuous cross section lends itself to plastic extrusion techniques.

The fastener concealment member can be attached to its channel in any suitable way. For example, the channel may include first and second projections which extend into the channel and are engageable with the fastener concealment member to at least assist in retaining the fastener concealment member in the channel.

The molding also advantageously includes wall means for defining an elongated channel which is adapted to receive an elongated peripheral portion of the panel. A portion of the wall means lies between the interiors of the two channels. In use, a fastener can be driven through the fastener concealment member and such portion of the wall means into the panel with the fastener concealment member at least partially concealing the head of the fastener.

The panel embracing channel preferably includes first and second legs and means for interconnecting the legs. The legs are resiliently movable toward and away from each other. In the unrestrained position, the legs converge so that they tend to resiliently grip a peripheral portion of the panel on which the molding is mounted. This resilient quality can be advantageously provided by interconnecting the legs, in part, with means to cooperate with the first leg to define a reverse bend section.

The molding also may include an elongated tubular section which is utilized for containing an angle member for attaching adjacent molding members together at the corners of the door. If desired, portions of the reverse bend section and the tubular section may form opposite sides, respectively, of the channel for the fastener concealment member.

The invention, together with further features and advantages thereof, may best be understood by reference to the following description taken in connection with the accompanying illustrative drawing.

DESCRIPTION OF THE PREFERRED EMBODIMENT

Figure 1:
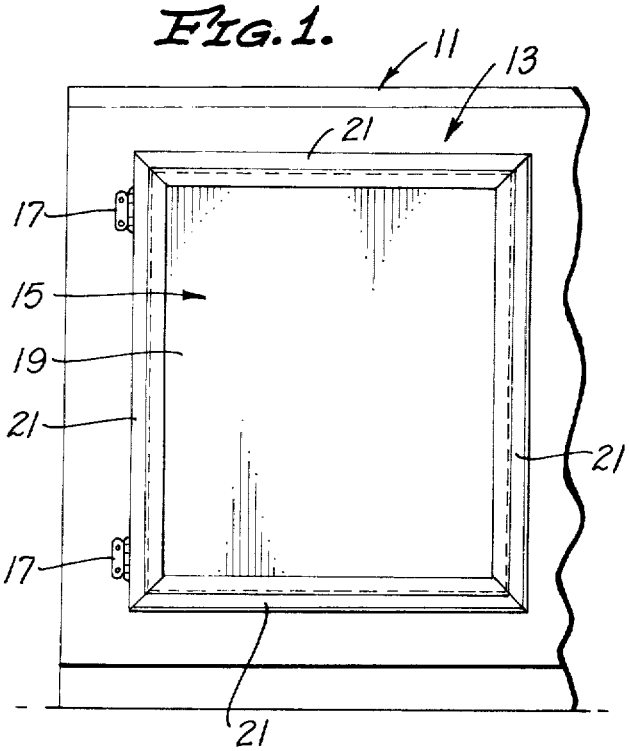
FIG. 1 is a fragmentary, front elevational view of a cabinet having a door structure constructed in accordance with the teachings of this invention.

FIG. 1 shows a cabinet 11 including a front wall 13 and a door 15. The cabinet 11 includes a pair of hinges 17 which attach the door 15 to the wall 13 for movement about a vertical pivotal axis.

The door 15 includes a broad panel 19 of particle board or other suitable material and a plurality of elongated moldings or molding members 21. Although various arrangements of the molding members 21 can be utilized, in the embodiment illustrated, the panel 19 is rectangular and four of the molding members 21 are provided with the four molding members extending along the four sides, respectively, of the panel.

Figure 3:
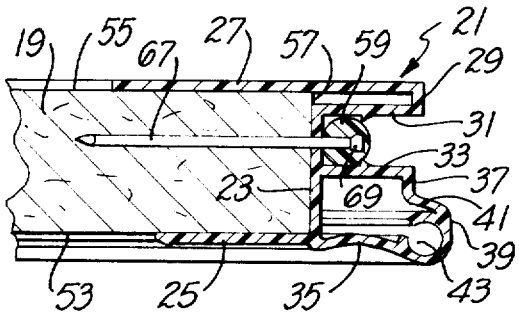
FIG. 3 is a sectional view taken generally along line 3—3 of FIG. 2.

The cross sectional configuration of one of the molding members 21 is shown in FIG. 3. The cross sectional configuration shown in FIG. 3 is identical for each of the molding members 21. In addition, the cross sectional configuration shown in FIG. 3 extends continuously throughout the full length of each of the molding members 21, except for the mitered corners which are discussed more fully hereinbelow.

The molding member 21 shown in FIG. 3 includes a generally planar back wall 23, a front leg 25 integrally joined to the back wall 23 and a rear leg 27 integrally joined to the back wall 23 by a web 29 and a leg 31. The legs 25 and 27 extend away from the back wall 23 generally transverse thereto and define opposite sides of a channel for receiving an elongated peripheral portion of the panel 19.

The back wall 23, the web 29, and the leg 31 serve to integrally join the legs 25 and 27. In the embodiment illustrated, the leg 31 is perpendicular to the back wall 23 and to the web 29. The web 29 is perpendicular to the leg 27. Preferably the legs 25 and 27 converge as they extend away from the back wall 23 when the legs are unrestrained, i.e. before the peripheral portion of the panel 17 has been inserted therein. The legs 25 and 27 are resiliently movable toward and away from each other to permit the legs to resiliently grip the peripheral portion of the panel 19 which is inserted therein. The web 29 and the leg 31 cooperate with the leg 27 to define a reverse bend section which opens into the panel receiving channel and which integrally joins the leg 27 to the back wall 23. This increases the resilience of the leg 27 by significantly increasing its dimension in a direction transverse to the back wall 23.

A leg 33 is integrally joined to a central region of the back wall 23 and projects generally perpendicularly away from the back wall generally parallel to the leg 31. A portion of the back wall 23 defines a web for integrally interconnecting the legs 31 and 33. The legs 31 and 33 and such portion of the back wall 23 cooperate to define a recess or channel which opens in a direction opposite to the panel 19.

An arcuate front wall 35 is integrally joined to the back wall 23 and extends away from the back wall in generally the same direction as the leg 33. The outer ends of the leg 33 and the front wall 35 are integrally joined by parallel wall sections 37 and 39 and by interconnecting wall section 41. The leg 33, a portion of the back wall 23, the front wall 35, and the wall sections 37, 39 and 41 cooperate to define a tubular section. Wall means within the tubular section define a part cylindrical socket 43.

Figure 2:
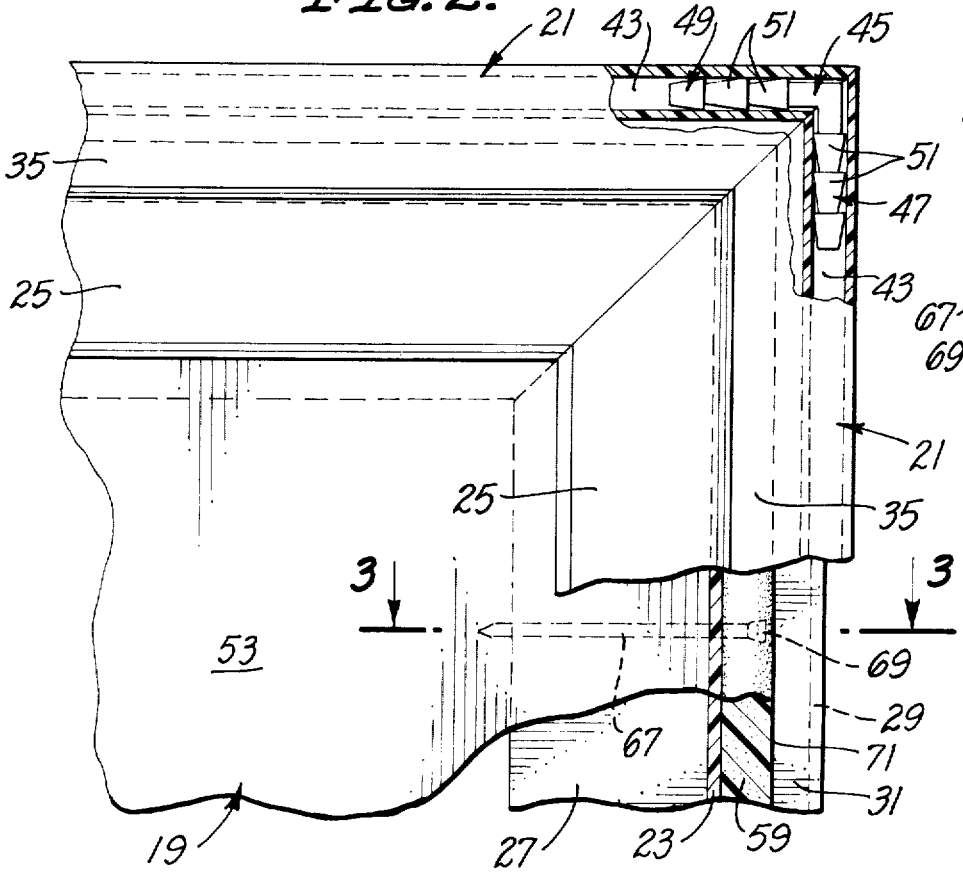
FIG. 2 is an enlarged, fragmentary, front elevational view partially in section of a portion of the door structure.

As shown in FIG. 2, the corners of the molding members 21 are mitered. The molding members 21 can be releasably interconnected at their corners in a manner similar to that shown in U.S. Pat. Nos. 3,426,482 and 3,479,770. An angle 45 of plastic material is used to releasably attach the corners of the molding members 21. The angle 45 has perpendicular arms 47 and 49 which are receivable in the sockets 43 of the adjacent molding members 21, respectively. Each of the arms 47 and 49 includes a sharp-edged, coaxial, frustoconical sections 51 which facilitate insertion of the arms 47 and 49 into the sockets 43 and inhibit their withdrawal. The angle 45 is merely illustrative of one manner in which the corners of adjacent molding members 21 can be interconnected.

As shown in FIG. 3, the panel 19 has an outer face 53, an inner face 55, and an edge 57. In assembling the door 15, the legs 25 and 27 of the molding member 21 are spread apart to receive a peripheral portion of the panel 19. As shown in FIG. 3, the legs 25 and 27 frictionally grip a peripheral portion of the faces 53 and 55, respectively, of the panel 19 and the edge 57 engages the back wall 23.

It is necessary to attach the molding members 21 to the panel 19 to maintain the relative position shown in FIG. 3. This can be accomplished adhesively and/or by the use of fasteners. Even if an adhesive is used, it is often necessary to utilize fasteners to hold the molding member 21 on the panel 19 while the adhesive cures.

Figure 4:
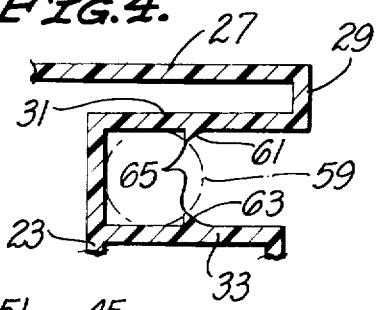
FIG. 4 is an enlarged fragmentary sectional view of a portion of one of the molding members.

The present invention provides a fastener concealment member 59 (FIGS. 2–4) in the channel formed by the legs 31 and 33 and a portion of the back wall 23. In the embodiment illustrated, the fastener concealment member 59 is in the form of an elongated cylindrical body which extends for the full length of the legs 31 and 33. Although other materials could be used, in the embodiment illustrated the fastener concealment member 59 is made from a rigid foam plastic material such as polyvinylchloride. The fastener concealment member 59 is held in its channel by elongated barbs or projections 61 and 63 (FIG. 4) which are integral with the legs 31 and 33, respectively, and which extend for the full length of their associated legs. As shown in FIG. 4, the projections 61 and 63 lie on the side of the center of the fastener concealment member 59 opposite the back wall 23. Each of the projections 61 and 63 has a sharp edge 65 sized to be engageable with the fastener concealment member 59 to hold the same within the channel.

The fastener concealment member 59 has a rigid outer surface 71. The fastener concealment member 59 is thicker, softer, and more easily penetrated than the back wall 23.

Figure 5:
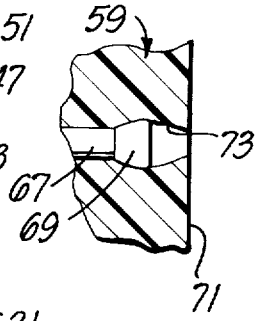
FIG. 5 is an enlarged, fragmentary, sectional view of the fastener concealment member and a fastener.

In use, a fastener such as a nail 67 can be driven through the fastener concealment member 59 and the back wall 23 into the panel 19 to mount the molding member 21 on the panel. The nail 67 has a head 69 which can be driven inwardly beyond the outer surface 71 of the fastener concealment member 59. As the head 69 of the fastener 67 is driven into the fastener concealment member, it tears away and/or permanently deforms the material of the fastener concealment member which is directly in its path. Consequently the head 69 can be countersunk in the fastener concealment member and leave only a small diameter hole 73 (FIG. 5) rather than a wide depression, between the head 69 and the outer surface 71. The foam material of the fastener concealment member 59 tends to expand over the head 69 of the nail. This tends to shrink the cross sectional dimensions of the hole and to conceal the head of the nail.

The molding member 21, except for the fastener concealment member 59, can be extruded from a suitable plastic material such as polyvinylchloride. The surfaces of the molding member 21 are hard. The fastener concealment member 59 can, if desired, be foamed in place as the remainder of the molding member 21 is being extruded. With this method of manufacture, the molding member 21 is of two-piece construction with each of the two pieces being integral.

Although an exemplary embodiment of the invention has been shown and described, many changes, modifications and substitutions may be made by one with ordinary skill in the art without necessarily departing from the spirit and scope of this invention.

I claim:

1. A molding for a panel comprising:

wall means for defining an elongated channel, said channel opening in a first direction and being adapted to receive an elongated peripheral portion of the panel;

first means on said wall means for defining a recess, said recess opening in a second direction, said first and second directions being different;

a portion of said wall means lying between the interior of said channel and the interior of said recess; and a fastener concealment member in said recess, said fastener concealment member being softer than said wall means and having a rigid outer surface, said rigid outer surface being penetrable by a fastener and the head of the fastener whereby with the molding on the panel the fastener can be driven through the fastener concealment member and said portion of said wall means into the panel with the fastener concealment member at least partially concealing the head of the fastener.

2. A molding as defined in claim 1 wherein said fastener concealment member is thicker and of lesser density than said portion of said wall means.

3. A molding as defined in claim 1 wherein said wall means includes first and second legs and means for interconnecting said legs with the legs converging as they extend outwardly from the interconnecting means when the legs are unrestrained, said legs defining opposite sides of said channel, respectively, said first means including a second elongated channel, said second channel having said recess therein, and said first and second directions being generally opposite.

4. A molding as defined in claim 1 wherein said first means includes a second elongated channel and said second channel includes third and fourth legs, and first and second projections on said third and fourth legs, respectively, said projections extending toward each other into the second channel and being engageable with the fastener concealment member to at least assist in retaining the fastener concealment member in the second channel.

5. A molding as defined in claim 1 wherein said wall means includes first and second legs and means for interconnecting said legs, said interconnecting means includes a back wall and means cooperating with said first leg to define a reverse bend section which opens into said channel for attaching the first leg to the back wall, said second leg being attached to the back wall, said legs defining opposite sides of said channel and being resiliently movable toward and away from each other.

6. A molding for a panel comprising:

wall means for defining an elongated channel, said channel opening in a first direction and being adapted to receive an elongated peripheral portion of the panel;

said wall means including a back wall, first and second legs, and means for interconnecting the first and second legs to the back wall with said legs extending away from said back wall, said first and second legs defining opposite sides of said channel, respectively;

first means on said back wall for defining a second elongated channel opening in a second direction which is generally opposite to said first direction; and an elongated fastener concealment member in said second channel, said fastener concealment member including foam plastic material.

7. A molding as defined in claim 6 wherein said first and second legs are resiliently movable toward and away from each other and said foam plastic material is rigid.

8. A molding as defined in claim 6 wherein said interconnecting means includes means cooperating with the first leg to define a reverse bend section for integrally joining the first leg to the back wall, said first means including third and fourth legs defining opposite sides of said second channel, a first portion of said back wall forming a web for interconnecting said third and fourth legs, said reverse bend section including a portion of said third leg.

9. A molding as defined in claim 8 including means including a second portion of said back wall and said fourth leg for defining an elongated tubular section.

10. A molding as defined in claim 9 wherein said wall means, said first means, and said tubular section are integrally constructed of plastic material and are integral with each other, and said foam plastic material is rigid, said molding including first and second projections formed integrally with said third and fourth legs, respectively, said first and second projections extending into said second channel and being engageable with said fastener concealment member to at least assist in retaining the fastener concealment member in said second channel.

11. A door structure comprising:

a panel;

a plurality of molding members, said molding members being arranged along the periphery of the panel to define at least a portion of a frame for the panel;

each of said molding members including wall means for defining an elongated channel, said channel receiving an elongated peripheral portion of the panel, first means on said wall means for defining a recess, said recess opening in a direction away from said panel, a portion of said wall means lying between the interior of said recess and said panel;

a fastener concealment member in said recesses; and a fastener extending through said fastener concealment member and said portion of said wall means into said panel to at least assist in attaching at least one of said moldings to said panel, said fastener having an outer end which is sunk into the fastener concealment member and is at least partially concealed thereby.

12. A door structure as defined in claim 11 wherein said fastener concealment member is thicker than said portion of said wall means.

* * * * *